US005684457A

United States Patent [19]

Miller et al.

[11] Patent Number: 5,684,457

[45] Date of Patent: Nov. 4, 1997

[54] TAMPER INDICATION SYSTEM FOR COMBINATION LOCKS

[75] Inventors: J. Clayton Miller, Nicholasville, Ky.; Michael P. Harvey, Park City, Utah

[73] Assignee: C&M Technology, Inc., Nicholasville, Ky.

[21] Appl. No.: 755,935

[22] Filed: Nov. 25, 1996

Related U.S. Application Data

[63] Continuation of Ser. No. 456,402, Jun. 1, 1995, abandoned.

[51] Int. Cl.[6] ..... G08B 13/06

[52] U.S. Cl. ..... 340/543; 307/119; 335/205; 335/207; 335/222; 340/665; 340/525.31; 340/825.32

[58] Field of Search ..... 340/543, 542, 340/665, 540, 825.31, 825.32; 307/119; 334/205, 222, 207

[56] References Cited

U.S. PATENT DOCUMENTS

| | | | |
|---|---|---|---|
| 2,842,631 | 7/1958 | Martens | 340/542 |
| 3,353,383 | 11/1967 | Fish | 340/543 |
| 4,129,865 | 12/1978 | Randall | 340/542 |
| 4,262,284 | 4/1981 | Stieff et al. | 340/542 |
| 4,331,945 | 5/1982 | Cattani, II | 335/205 |
| 4,360,803 | 11/1982 | Heiland | 340/542 |
| 4,503,422 | 3/1985 | Hsu | 340/543 |
| 4,772,877 | 9/1988 | Rice, Jr. et al. | 340/543 |
| 4,901,057 | 2/1990 | Suneborn | 340/542 |
| 5,041,814 | 8/1991 | Lin | 340/542 |
| 5,061,923 | 10/1991 | Miller et al. | 340/825.31 |
| 5,198,789 | 3/1993 | Taylor | 335/205 |
| 5,410,301 | 4/1995 | Dawson et al. | 340/825.31 |
| 5,479,151 | 12/1995 | Lavelle et al. | 340/542 |
| 5,493,279 | 2/1996 | Dawson et al. | 340/542 |

FOREIGN PATENT DOCUMENTS 0 617 185 A1 9/1994 European Pat. Off. .

*Primary Examiner*—Glen Swann

*Attorney, Agent, or Firm*—Lowe, Price, LeBlanc & Becker

[57] ABSTRACT

A tamper indication system for use with combination locks can indicate or signal that unauthorized manipulation of one or more of the lock components has occurred. In one mode, the tamper indication system senses unauthorized retraction of the lock bolt. Unauthorized movement of the lock cover or combination dial can also be sensed. Sensing can be achieved by generating a mechanical action responsive to the unauthorized manipulation and converting the mechanical action into an electrical signal for sensing and indicating. The mechanical action can utilize a snap action motion generation system, non-contact means such as magnets or a spring biased switch.

4 Claims, 10 Drawing Sheets

TAMPER INDICATION SYSTEM FOR COMBINATION LOCKS

This application is a continuation of application Ser. No. 08/456,402 filed Jun. 1, 1995.

FIELD OF THE INVENTION

The present invention is directed to a tamper indication system for combination locks and, in particular, to a system which senses unauthorized movement of a lock component and provides an indication that such unauthorized movement has occurred.

BACKGROUND ART

In the prior art, electrical and mechanical combination locks are well known. In U.S. Pat. No. 5,061,923 to Miller et al., a computerized combination lock is disclosed which is fully computerized and self powered. A rotary dial is connected to a stepper motor/generator to provide the electrical power to a capacitor to power the system. The stepper motor/generator also provides input signals in the form of a code sequence to a microprocessor that processes the signals to initiate the operation of a drive motor to release a lock bolt once the proper combination is dialed. A read only memory determines the proper combination from a combination storage means and feeds the combination to the microprocessor for comparison to the inputted signals from the dial. During the combination dialing, a display unit presents the code and direction of movement of the sequence for observation by the person dialing the combination. The disclosure of the Miller et al. patent is hereby incorporated by reference in its entirety.

One drawback of prior art combination locks is the inability to detect and sense unauthorized manipulation of lock components. As such, a need has developed to provide a system which senses unauthorized movement or manipulation of a lock component and which provides an indication of such movement or manipulation so that an authorized user of the lock is aware that surreptitious entry or an attempt of entry has been made.

In response to this need, the present invention provides a tamper indication system for combination locks, particularly, computerized combination locks which permits an authorized user to know when unauthorized manipulation or lock component movement has occurred.

SUMMARY OF THE INVENTION

Accordingly, a first advantage of the present invention is in provision of a combination lock having a tamper indication system.

Another advantage of the present invention is in provision of a computerized combination lock with a tamper indication system.

A further advantage of the present invention is in provision of a tamper indication system for a combination lock that is resettable upon dialing one or more of the correct combinations for the lock.

A still further advantage of the present invention is in provision of a combination lock which utilizes either mechanical, electro-mechanical or electrical means to both sense and indicate unauthorized manipulation of a lock component.

Other advantages of the present invention will become apparent as a description thereof proceeds.

In producing the foregoing advantages, the present invention is an improvement in a combination lock for a secured area wherein the lock comprises a combination input means or device mounted outside of the secured area and a lock assembly arranged within the secured area. The improvement comprises a tamper indication system which includes means for sensing unauthorized movement of a component of the combination lock and indicating occurrence of the unauthorized movement.

Preferably, the tamper indication system is adapted for computerized combination locks having a combination input means such as a push button device or rotatable member mounted outside of the secured area, a power source such as a battery, external power supply or an electrical generator and a drive apparatus for imparting motion to the electrical generator, a microprocessor and lock assembly arranged within the secured area. The microprocessor is powered by the power source for operation of the computerized combination lock by combination dialing. A display is linked to movement of the rotatable member via the microprocessor for combination dialing indication.

According to the invention, a tamper indication system is provided with this computerized combination lock which includes means for sensing or detecting unauthorized movement of a component of the computerized combination lock and indicating occurrence of the unauthorized movement.

The lock component that can be monitored for movement preferably includes a combination dial, the dial ring, the dial spindle, the lock casing cover or the lock bolt.

The means for sensing unauthorized movement can comprise a means for generating a mechanical action and converting the mechanical action into an electrical signal for sensing by the microprocessor. Alternatively, the mechanical action can complete a circuit for sensing by the microprocessor.

In another embodiment, an external power source can be supplied for facilitating the sensing and indicating action of the inventive system.

Alternatively, the mechanical action can provide the indication by a destructive action such as breaking of a component such as a wire.

In a further embodiment of the invention, a self contained motion detection switch can be utilized for sensing of unauthorized manipulation of a lock component. This switch can also be used for detecting any type of motion for a desired purpose. In this embodiment, a switch housing is provided which includes an electromotive force generator and a spring-biased pin and magnet assembly. The pin is mounted with respect to the switch housing to detect movement by spring depression. Movement of the pin and magnet is detected in response to a voltage produced by the electromotive force generator. Means are provided for sensing the output of the electromotive force generator and providing a signal indicative of the movement sensed by the pin. Preferably, the switch housing includes an actuating arm pivotally mounted thereto for sensing of the motion to be detected.

BRIEF DESCRIPTION OF THE DRAWINGS

Reference is now made to the drawings of the invention wherein.

DESCRIPTION OF THE PREFERRED EMBODIMENTS

Figure 1:
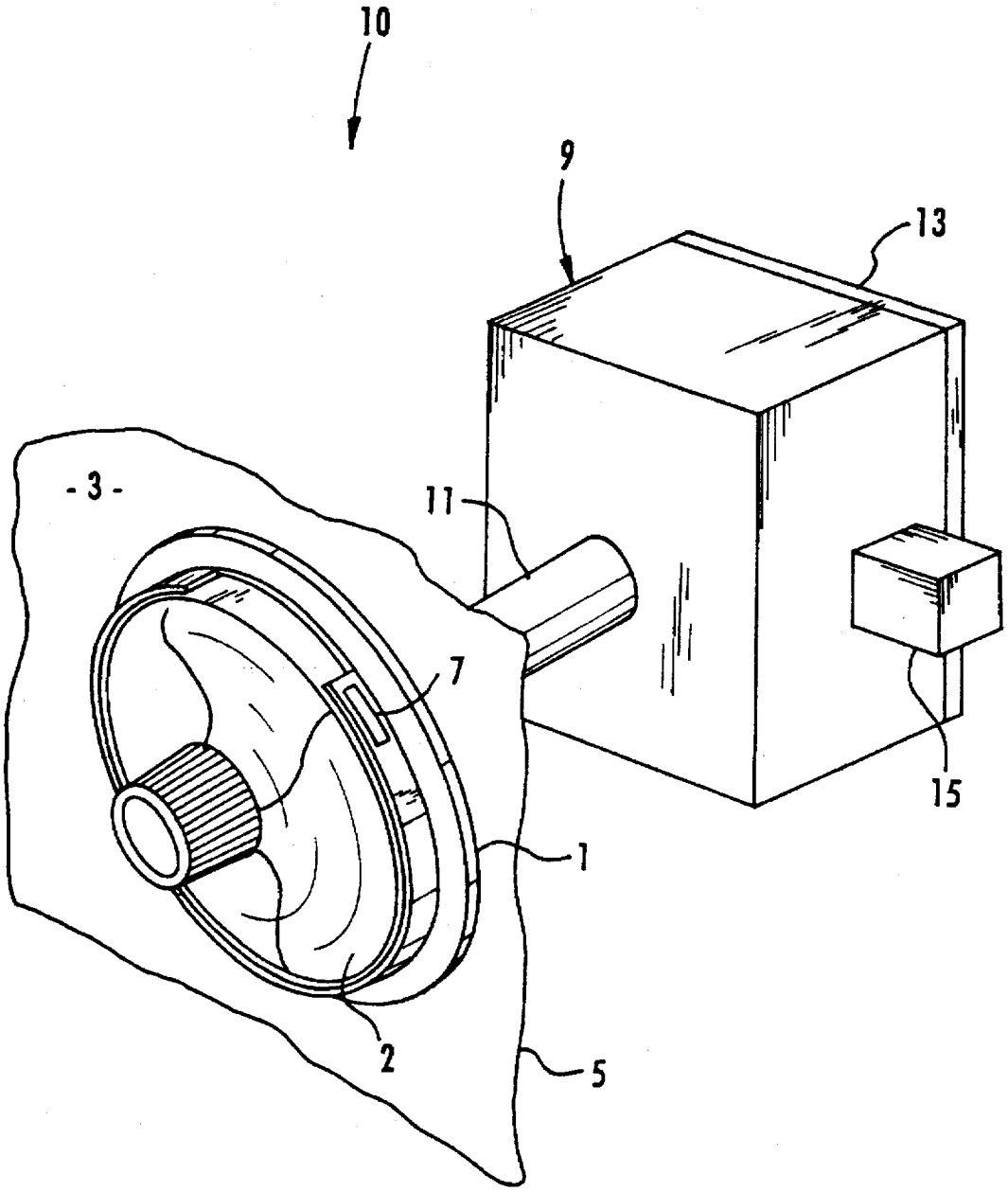
FIG. 1 is a perspective view of a computerized combination lock assembly.

With reference now to FIG. 1, a computerized combination lock assembly, generally designated by the reference numeral 10, includes a dial ring 1 and combination dial 2 mounted on the face 3 of a door 5 which provides access to a secured area.

The dial ring 1 includes a display 7 which, in this embodiment, indicates the combination numbers being dialed as well as an alert icon indicating tampering as described in more detail below. The combination dial 2 is operatively connected to the computerized combination lock mechanism (not shown) which is located in the lock casing 9 via the spindle 11. The lock casing 9 includes cover 13 for access thereto. A deadbolt 15 extends from the lock casing 9 for lock operation. The deadbolt 15 is shown in the extended position and is retractable once a proper combination is dialed.

The lock casing also houses the components and circuitry, e.g. the microprocessor, for operating the computerized combination lock as disclosed in the Miller et al. patent. Since these components and circuitry are well known, a further description thereof is not necessary for understanding of the invention.

It should be understood that the computerized combination dial lock assembly 10 is exemplary for use with the inventive tamper indication system. Any combination lock having components which could be improperly manipulated to gain entry to a secured area or to obtain other information is adaptable for use with the inventive tamper indication system. Other types of locks include mechanical combination locks or even locks employing keyed cylinders, or key pad entry.

FIGS. 2–6 depict the invention when utilizing an active source for tamper indication. The active source utilizes some form of mechanical motion which is transformed into an electromotive force that provides all the energy required to actively set a memory element of the tamper indication system. The memory element can then be read by the microprocessor of the computerized combination lock to determine if the memory element has been set while the lock was inactive. Setting of the memory element also provides indication of the unauthorized lock component manipulation so that an authorized user is alerted to the improper movement of a lock component.

Figure 2:
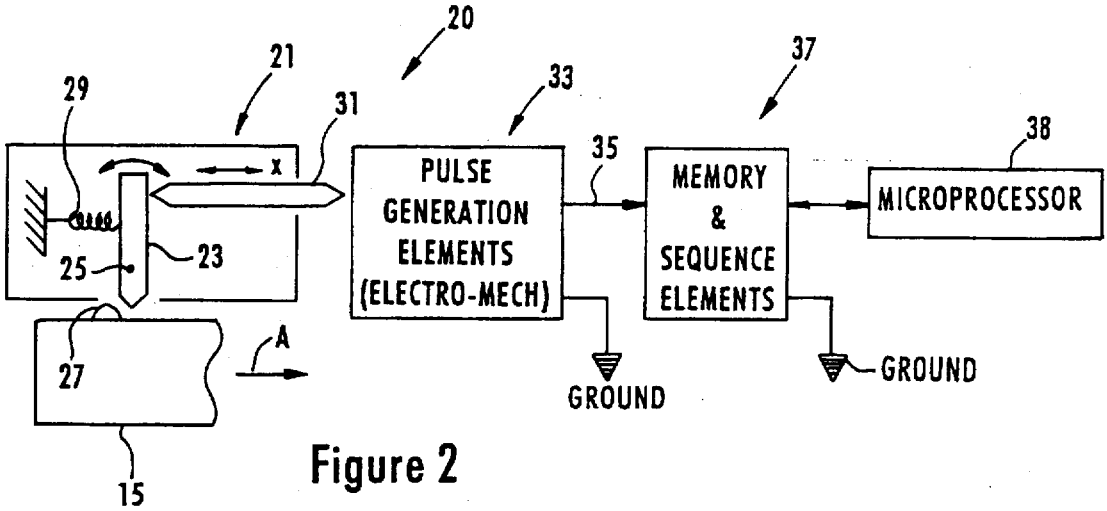
FIG. 2 is a schematic diagram of a first embodiment of the invention.

A first embodiment of the active source aspect of the invention is shown in FIG. 2. This system, generally designated by the reference numeral 20, employs a snap action motion generation system that generates a relatively constant snap motion without regard to how fast a component is moved, e.g. bolt retraction or lock casing cover removal.

A snap action mechanical powered generation system 21 is activated by retraction of the deadbolt 15 in the direction of arrow A. During deadbolt retraction, the pin 23 rotates on its pivot point 25 in a counter-clockwise direction as a result of pin contact with the protrusion 27 on the deadbolt 15. Continued retraction of the deadbolt 15 causes the protrusion 27 to travel past the rotated pin 23. Once the protrusion 27 passes beyond the pin 23, the spring 29 biases the pin in a clockwise direction against the snap action linkage 31. This snap action of the pin striking the linkage 31 causes the linkage to travel in the direction shown by arrow "X" Once the pin 23 strikes the linkage 31, it reverts back for subsequent movement detection by action of spring 29. Likewise, the linkage reverts back by a biasing spring (not shown) or the like.

Travel of the snap action linkage 31 interfaces with the power generation element system 33 to produce a pulsed electrical power 35.

The pulsed electrical power 35 is supplied to the memory and sequence element system 37 which interfaces with the computerized combination lock microprocessor 38 for tamper indication and resetting for subsequent detection and indication.

Figure 3A:
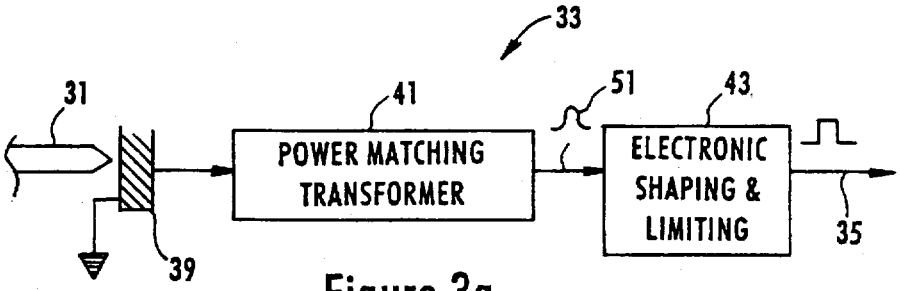
FIGS. 3*a* and 3*b* are alternative power generation element systems for the inventive tamper indication system.
Figure 3B:
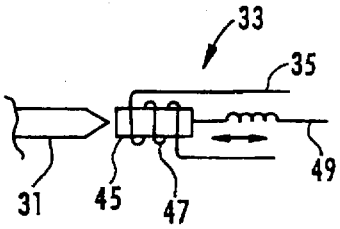

FIGS. 3*a* and 3*b* show exemplary power generation element systems. In FIG. 3*a*, a piezoelectric material 9 is used in conjunction with a power matching transformer 41 and an electronic shaping and limiting circuit 43. The piezoelectric material 39 generates a voltage when a force from the snap action linkage 31 is applied thereagainst. With the selection of a particular piezoelectric material 39 and knowing the motion force generated by the snap action linkage 31, a power matching transformer 41 can be selected along with the necessary circuitry to generate enough voltage and current (a raw pulsed power 51) to supply the memory and sequence elements 37.

FIG. 3*b* shows an alternative electromotive force generator using a moving magnet 45 and coil 47. The voltage at the coil output is proportional to the magnetic flux change and wire conductor turns. The magnet 45 is moved against the bias of the spring 49 by the movement of the snap action linkage 31. The voltage 35 generated by this electromotive force generation element 33 is supplied to the memory and sequence element system 37 as shown in FIG. 2.

Figure 4:
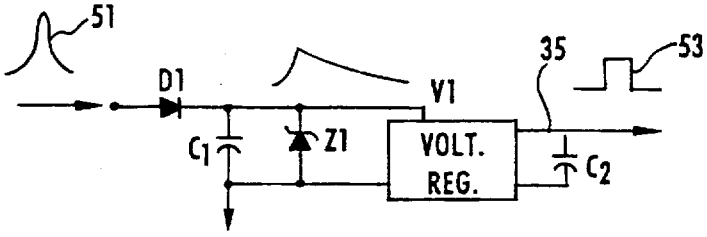
FIG.4 is an exemplary circuit for use with the embodiment depicted in FIG. 2.

With reference to FIG. 3*a* and 4, an exemplary circuit is shown to shape the pulsed power 51 from the transformer 41. The elements D1/C1/Z1 form a coarse peak limited voltage supply and storage for the voltage regulator. Voltage regulator V1 and smoothing capacitor C2 form a more precise regulated pulse 53 that may be required to set the memory elements of the memory and sequence system 37.

Figure 5:
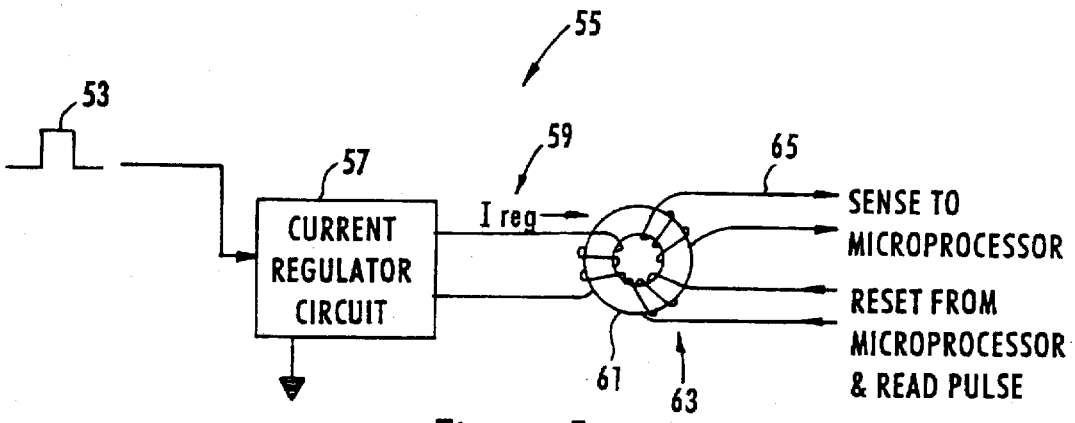
FIG. 5 is a schematic of a first type of memory element for use with the invention.
Figure 6:
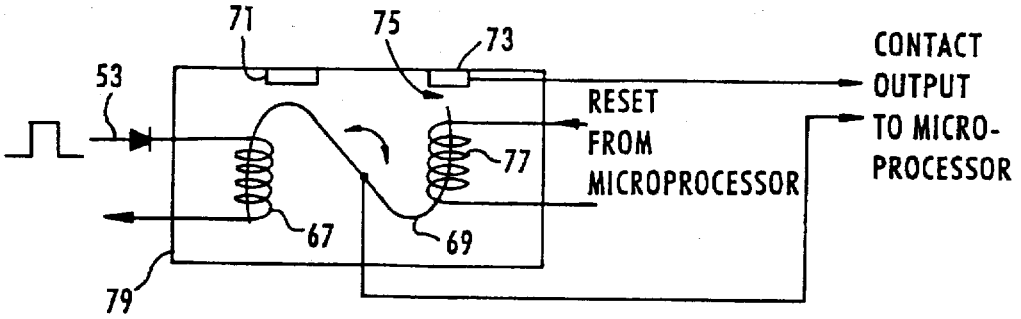
FIG. 6 is a schematic of a second type of memory element for use with the invention.
Figure 7:
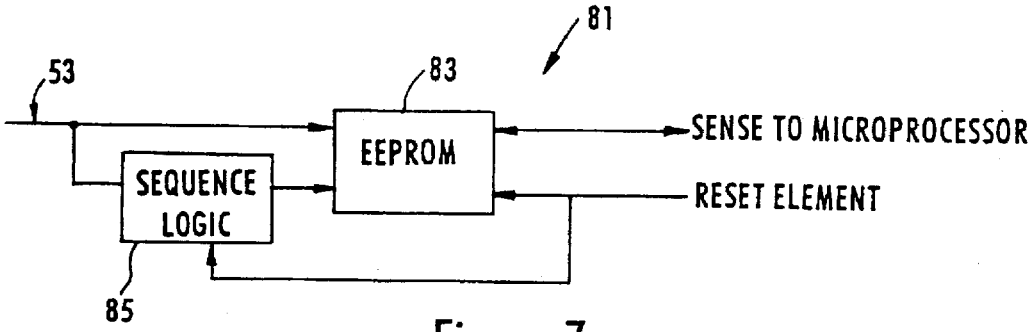
FIG. 7 is a schematic of a third type of memory element for use with the invention.

FIGS. 5–7 show three exemplary types of memory elements and control schemes that may be used in conjunction with the inventive tamper indication system. The memory element serves to record or retain a signal that one of the lock components has been improperly manipulated and to provide the requisite tamper indication. The memory element can then be reset so that subsequent improper manipulations or the like can be detected. FIG. 5 depicts a memory core element designated by the reference numeral 55. In operation, the pulsed electrical power 53 from the electronic shaping and limiting circuit 43 passes through a current regulator circuit 57 to produce a current $I_{reg}$ 59 to the coil 61 of the toroid 63. The current 59 magnetizes the toroid in the saturated set magnetic direction. When a read pulse is provided from the microprocessor, the sense lines 65 generate a voltage as the flux in the toroid 63 is saturated in the reset direction. If the toroid had been set since the last read, i.e. manipulation, the sense voltage generated will be much greater and can be detected by the microprocessor.

FIG. 6 illustrates a second type of memory element, i.e. a latching relay that is held latched by magnetic forces. However, other mechanical latching methods could be utilized in place of the magnetic means used in this embodiment.

The latching relay of FIG. 6 operates as follows. The pulsed electrical power 53 is applied to a coil 67 that sets the internal rocker arm 69 which is then held place by a magnetic field produced by the magnet 73. The magnetic pull of the coil 67 is of sufficient strength to pull the arm from the unlatched position as shown in FIG. 6 to the latched position. In the latched position, a contact closure is made at reference numeral 75.

When the microprocessor powers up, it can detect the contact closure at 75, thus obtaining a signal that improper manipulation of a lock component has occurred.

The microprocessor can then reset the rocker arm by applying current to the coil 77 that has enough pull to rock the magnetic arm 69 from the one bistable state wherein the contact closure 75 is made to the other unlatched bistable state and held by magnet 71. The entire latching relay is preferably enclosed in a magnetic shield 79.

FIG. 7 depicts a third solid state memory element embodiment as the memory and sequence element 37. The solid state solution is generally designated by the reference numeral 81 and is seen to include an electronically erasable programmable read only memory (EEPROM). These devices may be electronically set and reset with memory retention when power is removed. Sequence logic 85 is also provided to facilitate operation of the memory system 81.

In operation, the pulse 53 is supplied to the EEPROM and sequence logic. The microprocessor can then read the EEPROM to determine whether an unauthorized movement or manipulation has occurred. The microprocessor can also reset the EEPROM for subsequent tamper indication.

Although FIG. 7 depicts an EEPROM storage, a capacitor or other solid state latch may replace the EEPROM. Of course, different control circuitry would also be provided in these situations. One drawback of capacitor use is its shorter term memory capability. Although capacitor storage systems can be practically achieved that could maintain memory for years, EEPROM technologies are preferred since their storage times far exceed those of capacitor storage systems. Other solid state latches could be used with the disadvantage of requiring a continuous power supply, presumably from a battery. In a computerized combination lock such as that disclosed in the Miller et al. patent, batteries are not typically used. However, for alternative solid state latches as well as providing a real time clock to facilitate audit trails, the inventive tamper indication system can include an external power source.

Figure 8A:
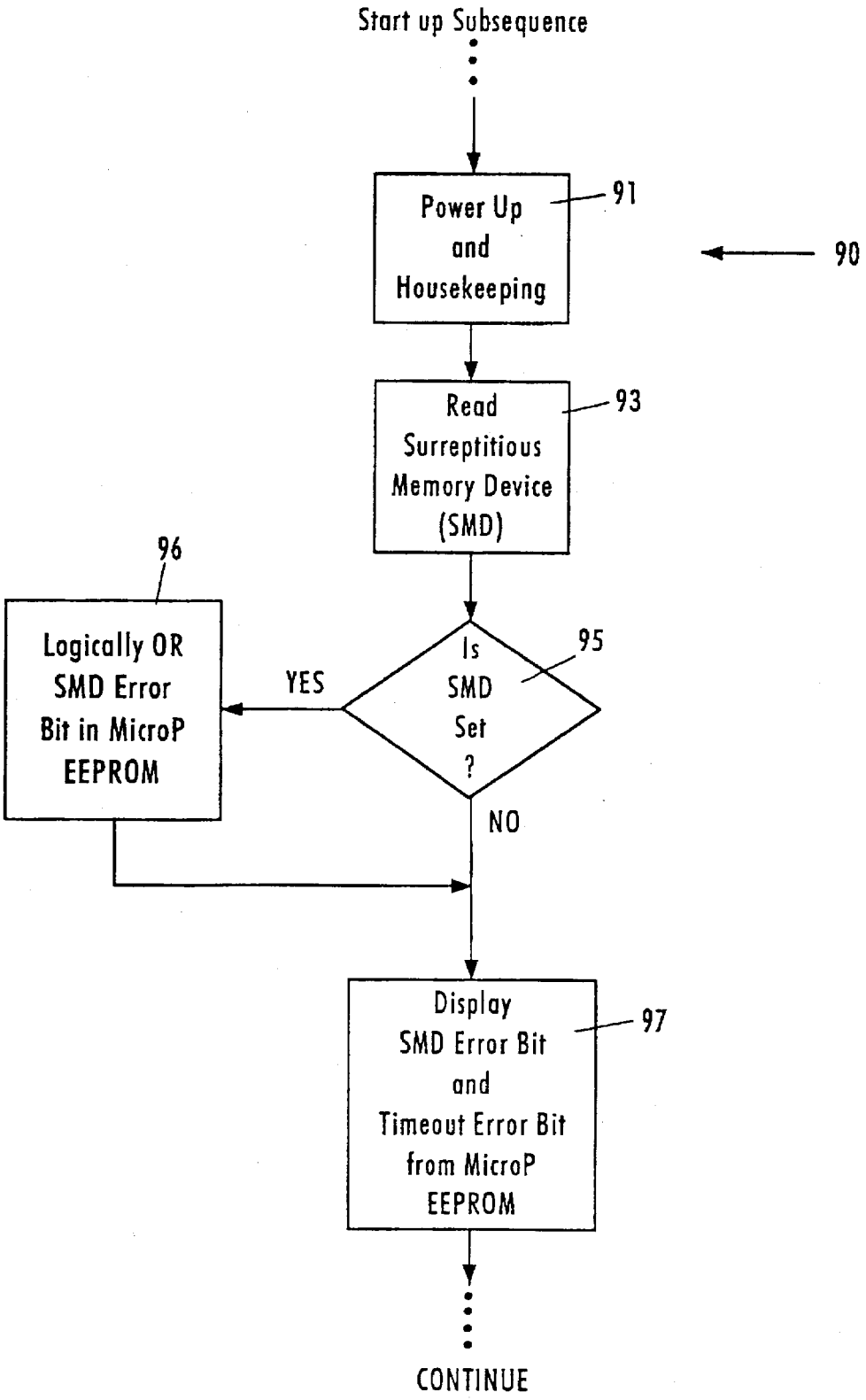
FIGS. 8A and 8B are exemplary microprocessor and bolt pull flow diagrams.

With reference to FIG. 8A, a simplified microprocessor start up flow chart subsequence, designated by the reference numeral 90, describes an exemplary lock start up operation.

In this basic sequence, a computerized combination lock employing a microprocessor such as that disclosed in the Miller et al. patent mentioned above is utilized. This sequence monitors bolt action as the unauthorized lock component manipulation. However, other computerized combination locks and sequences may be used to achieve the same or similar functions as described below.

For clarity in the following discussion, what has been termed the "memory element" will now be termed the Surreptitious Memory Device (SMD). Other terms introduced will include the microprocessor (MicroP), and Electronically Erasable Programmable Read Only Memory (EEPROM).

During lock operation, it is the function of the active mechanical source bolt mechanism to set the SMD. Of course, the reverse operation is also possible, i.e., every time the bolt extends into the locked position the SMD could be set. Thus, every time the bolt is pulled, the microprocessor resets the SMD under normal conditions. At power up, the SMD should be reset from the last authorized bolt pulling sequence unless the bolt was pulled when the lock was inactive, e.g. surreptitious entry.

After power and program start up at 91, the MicroP reads the SMD at 93. The MicroP then tests to determine if the SMD has been set surreptitiously at step 95 of FIG. 8*a*. If the device is set, i.e., unauthorized manipulation of a lock component has occurred, an error bit is logically ORed into an SMD display status bit with a set bit or other bit such as the time out bit described below at 96. At step 97, the errors are displayed, typically on an LCD display or the like and the normal program continues. Of course, other display indicators can be utilized as are known in the art. The displays should be capable of being reset after the next legitimate resetting of the SMD, e.g. correct combination dialing and opening has occurred. Resetting of the display can be achieved by requiring multiple successful correct combination dialing, if desired.

Figure 8B:
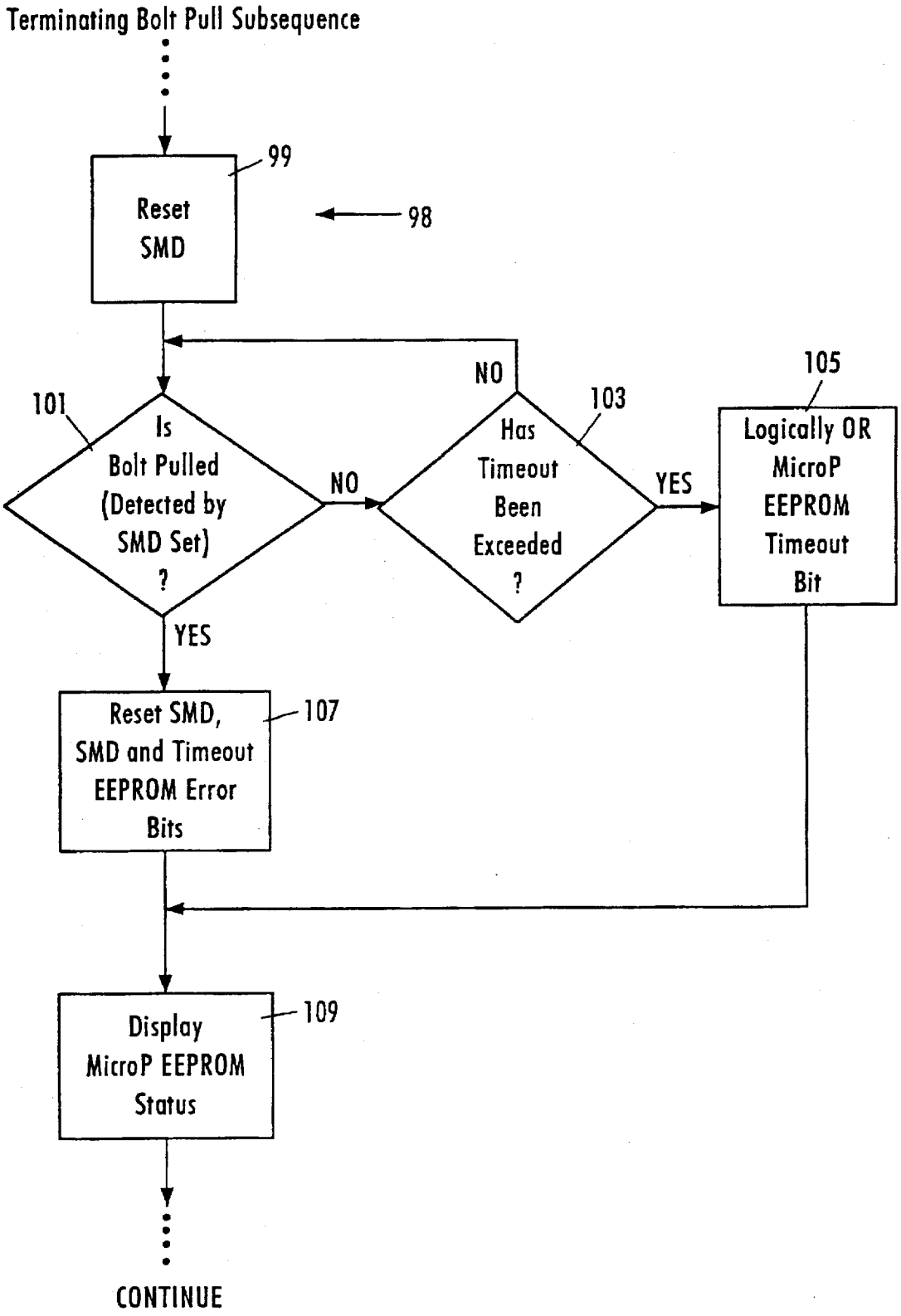

The terminating bolt pull subsequence is illustrated in FIG. 8B, and designated as the numeral 98. Prior to entering this subsequence, it is presumed that all conditions to allow lock bolt pulling has occurred including proper combination entry. In this example, the SMD will be utilized to detect lock bolt opening. Therefore the SMD is first reset at 99. At 101, the system tests if the bolt has been pulled. If the bolt is not pulled, a time out sequence loop 103 limits the time for bolt pulling. If the bolt is not pulled within a predetermined time set by the time out sequence loop 103, an EEPROM time out bit at 105 is set for display. After the bolt is pulled, a total legitimate lock opening has occurred and at 107 the SMD is reset, and the SMD and Time-out error bits in EEPROM are cleared. The present system status is then displayed at 109 and the program continues to conclusion.

Interpretation of the display status is as follows. If the SMD error is displayed without a time-out error, then a surreptitious entry has occurred. If both the SMD and time-out errors are displayed, it is likely that a time-out occurred and then the lock was opened. If only the Time-out error is displayed, then a time-out occurred and the bolt was never retracted even though the proper combination had been entered.

When mounting the active source, it is desirable to mount the components within the lock casing in a manner so they cannot be defeated by improper manipulation, preferably, in computerized combination lock assemblies using a potting material or resin to encase the electronics. The active source components such as the snap action switch, if required, and the related memory and control electronics would be incorporated in the resin material also. A simple mechanical linkage, e,g. a gear or lever arm, could then be used to interconnect the lock component to be monitored with any mechanical linkage encased by the resin material.

Figure 9:
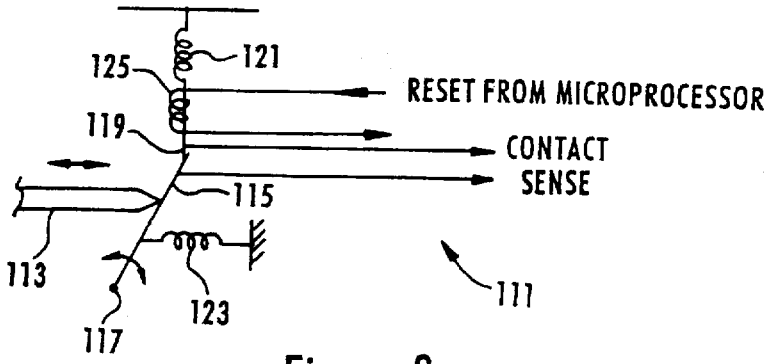
FIG. 9 is a schematic of the passive source embodiment of the invention.

In an alternative embodiment, a passive source can be used to define the memory element system that would not require any electronic power to set the memory element. With reference to FIG. 9, a passive source schematic is generally designated by the reference numeral 111. A linear or rotational movement caused by a lock component movement and designated by the reference numeral 113 is applied to the latch bar 115. The latch bar is pivotally mounted at pivot point 117. The pivoting movement of the latch bar 115 causes the solenoid bar 119 to push up by reason of the solenoid bar tip bevel (not shown). After the latch bar 115 passes the beveled tip of the solenoid bar 119, the solenoid bar 119 drops down again and returns to its rest state by virtue of the spring 121, this configuration being shown in FIG. 9. When the mechanical motion 113 reverses, the latch bar 115 attempts to return by virtue of the spring 123 under compression as shown. However, the latch bar 115 is restrained from returning by the solenoid tip. Thus, the latch bar 115 and solenoid 119 make contact which can be sensed by the microprocessor.

The microprocessor can reset the latch condition by energizing the solenoid coil 125. Energizing the solenoid coil 125 raises the beveled tip of the solenoid bar 119 so that the latch 115 can return to its unlatched and at rest state by decompression of the spring 123.

Figure 10A:
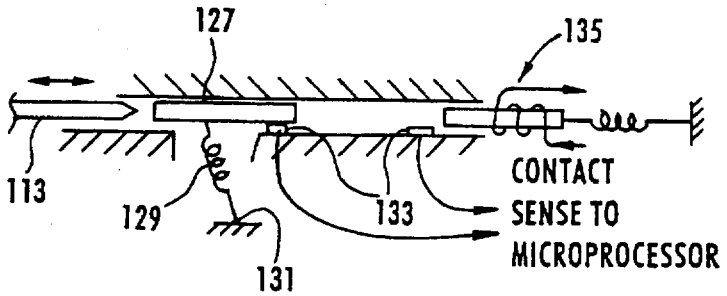
FIGS. 10*a* and 10*b* are alternative embodiments to the embodiment depicted in FIG. 9.
Figure 10B:
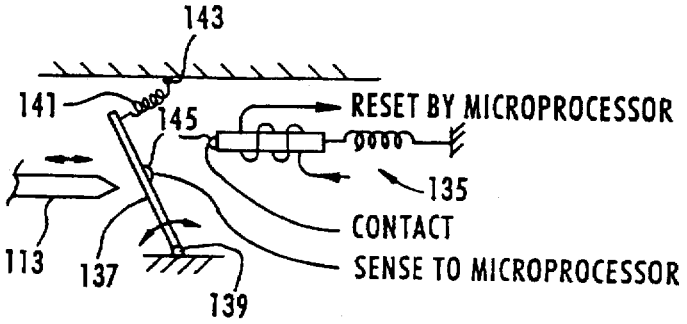

FIGS. 10*a* and 10*b* show alternative embodiments to that depicted in FIG. 9 for a mechanical set/electronic reset bistable spring hold. With reference to FIG. 10*a*, a mechanical set/electronic reset bistable spring hold is depicted. In theory, this spring hold operates based on a compression spring. That is, a latch bar is connected to the compression spring. When the latch bar is displaced due to a mechanical motion representing an unauthorized movement of a lock component, the compression spring passes over a rotational spring axis. The spring then expands rapidly until it is no longer compressed. It remains in the uncompressed state until an external force forces it back to the beginning bistable state. In FIG. 10*a*, a linearly restrained latch bar 127 (at rest) is fixed to a compression spring 129 which has a rotational spring axis at 131. When the latch bar 127 is moved as a result of the mechanical action represented by the reference numeral 113, the latch bar 127 is translated towards the solenoid 135. During translation, the spring 129 expands and facilitates latch bar movement toward the solenoid 135. The latch bar then closes the contacts 133 which can be sensed by the microprocessor to indicate that the mechanical movement 113 has occurred. The solenoid 135 can then be energized to reset the latch bar back to the position shown in FIG. 10*a* for detection of subsequent mechanical motion 113. The solenoid 135 is conventional and is does not require any further explanation as to its operation.

FIG. 10*b* shows an arrangement similar to FIG. 10*a* except for the use of a rotating latch bar 137 rather than the linearly constrained latch bar 127. In this embodiment, the latch bar 137 pivots about rotational axis 139 and is secured by the compression spring 141 having its own rotational spring axis 143. The mechanical motion 113 forces the latch bar 137 in a clockwise position to close the contacts 145 for sensing by the microprocessor. The solenoid 135 can then be energized to reset the latch bar 137 for subsequent detection of mechanical motion 113.

Figure 11A:
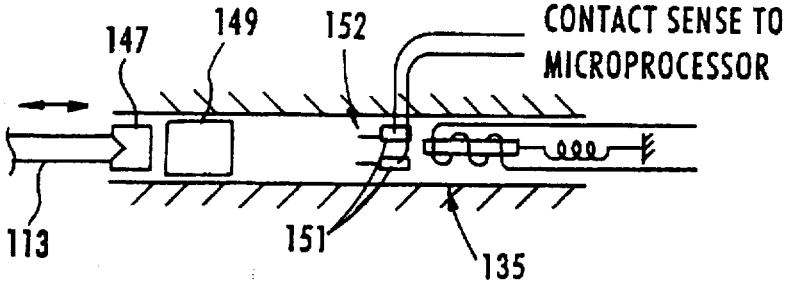
FIGS. 11*a* and 11*b* are further alternatives to the embodiment depicted in FIG. 9.
Figure 11B:
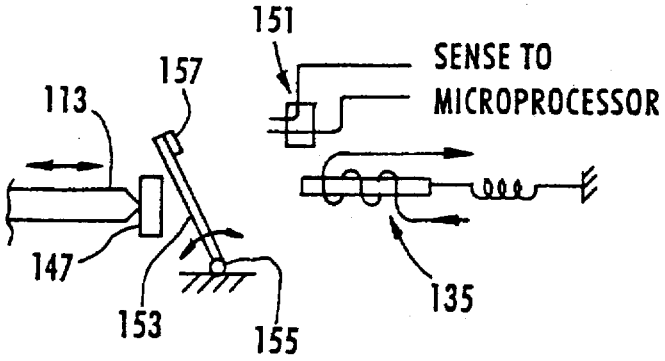

FIGS. 11*a* and 11*b* show alternative bistable holds utilizing magnetic attraction rather than the compression springs as shown in FIGS. 10*a* and 10*b*. In FIG. 11*a*, the mechanical action 113 utilizes a magnet 147 on an end thereof. A linearly constrained magnetic latch bar 149 is provided for travel towards the annular magnet 151. Mechanical motion 113 forces the magnetic latch bar toward the magnetic 151, the magnetic attraction therebetween closing the contacts 152 for sensing by the microprocessor. Again, a solenoid 135 is provided which forces the mechanical latch bar 149 back toward the magnet 147 for subsequent operation.

FIG. 11*b* is similar to FIG. 10*b* in that a magnet 157 is used with the latch bar 153 rather than a compression spring. In operation, the latch bar 153 rotates on its rotational axis 155 between the reset position as shown in FIG. 11*b* and a set position. The set position occurs when the mechanical motion 113 drives the latch bar 153 to close the contacts 151, contact closure being sensed by the microprocessor. The latch 153 is returned to its reset position by the solenoid 135.

Figure 12:
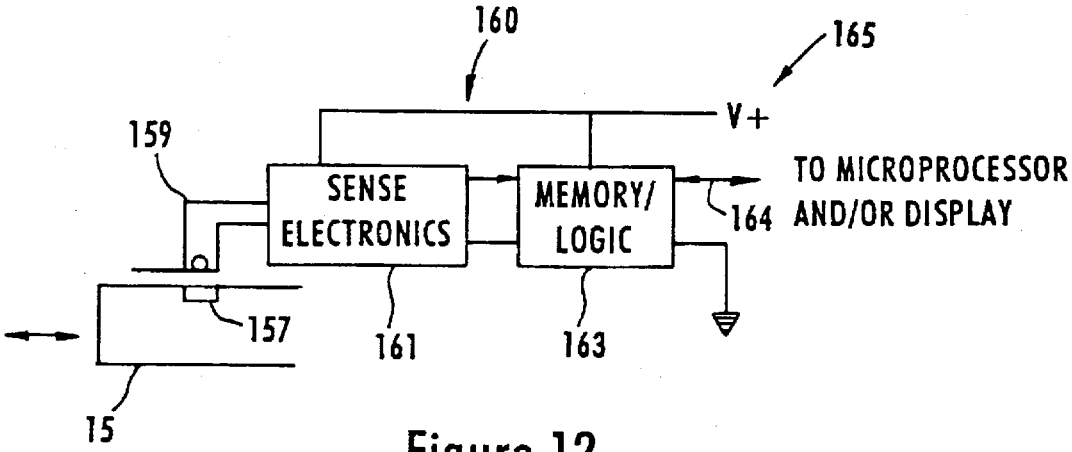
FIG. 12 is a schematic of the inventive tamper indication system using an external power source.

With reference to FIG. 12, a schematic of an externally powered tamper indication system is generally designated by the reference numeral 160. In this schematic, a non-magnetic bolt 15 having a magnet 157 therein is shown as representative of the movement of a lock component. A magnetic pick up 159 is provided which is known in the art and can sense movement of the magnet 157. Sense electronics 161 and memory/logic 163 provide the circuitry to send a signal 164 to the microprocessor for indicating that movement of the bolt 15' or other lock component has occurred. The system is supplied by the power source 165.

In these powered systems, an audit trail can be provided which utilizes a real time lock. In a system such as this, the audit trail would detect when a combination was dialed for lock opening and what particular combination was used. In electronic locks, different combinations can be programmed for lock opening. The audit trail can then be stored in the system memory and reviewed to determine when the combination was dialed and whether such dialing was authorized.

Figure 13A:
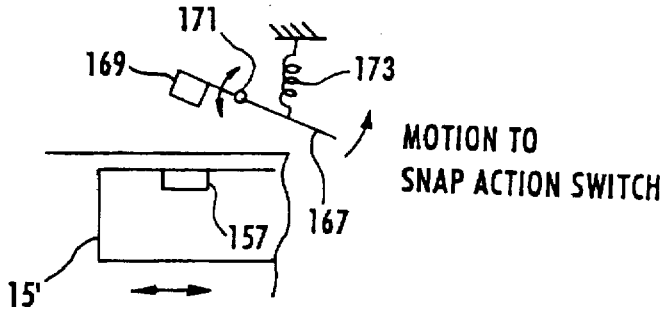
FIGS. 13*a*, 13*b* and 13*c* depict alternative non-contact mechanisms for the inventive tamper indication system.
Figure 13B:
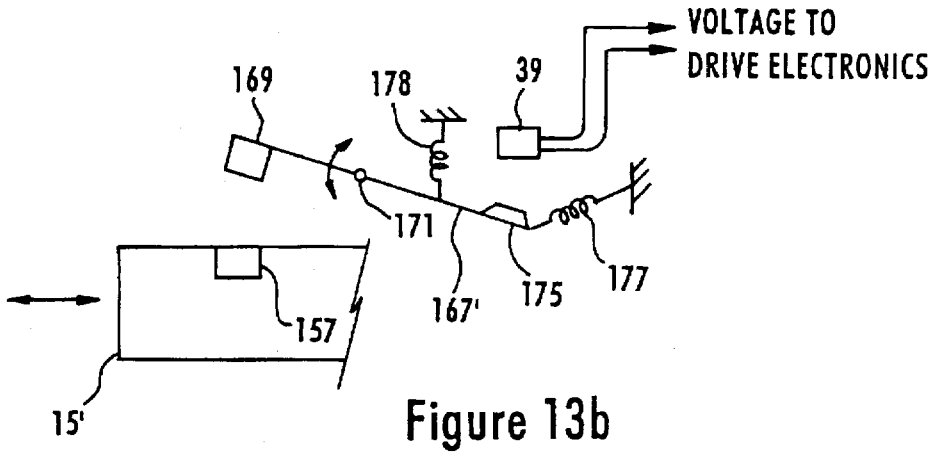
Figure 13C:
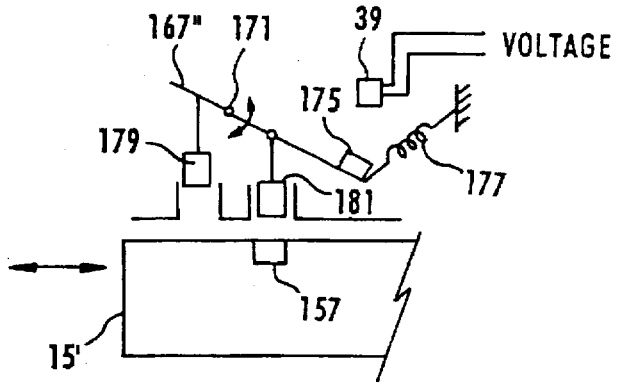

In the previous embodiments, a physical contact system is used to initiate and maintain movement until contact closure occur. In FIGS. 13*a–c*, non-physical contact systems are schematically illustrated. In FIG. 13*a*, the bolt 15' with a magnet 157 therein interfaces with a rotating latch 167 having a magnet 169 on the end thereof. The rotating latch 167 pivots about reference numeral 171. The latch 167 also includes a restoring spring 173 which returns the latch 167 for subsequent operation. In function, the magnet 157 attracts the magnet 169 and causes the rotating latch 167 to pivot about its pivot point 171. The latch 167 provides a motion to a snap action switch as described in FIG. 2 for electromotive force generation.

FIG. 13*b* is similar to FIG. 3*a* in the use of a piezoelectric element 39. In this embodiment, the latch bar 167' includes a strike 175 which contacts the piezo-electric element 39 for voltage generation. A snap action spring 177 is provided to facilitate the snap action against the piezoelectric element 39. The snap action spring 177 action is similar to that described in FIG. 10*a*.

FIG. 13*c* is similar to FIG. 13*b* but utilizes a pair of magnets 179 and 181. In this embodiment, the magnet 157 of the bolt 15' attracts the magnet 181 in the reset position. Movement of the magnet 157 attracts the magnet 179 causing the latch 167" to rotate about pivot point 171 for contact against the piezoelectric element 39.

Figure 14A:
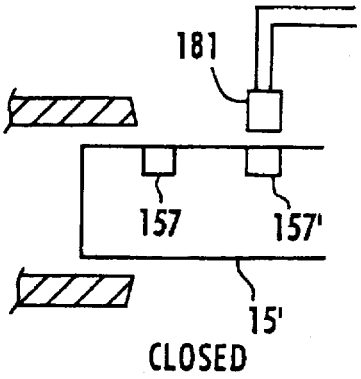
FIGS. 14*a* and 14*b* show a magnetic non-contact mechanism of the invention.
Figure 14B:
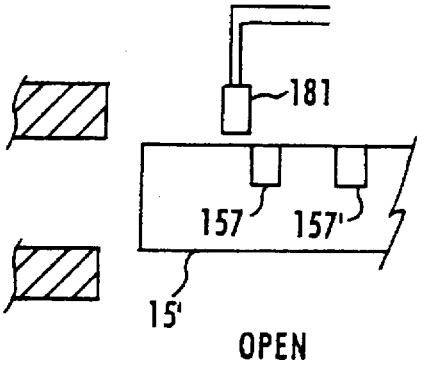

Although snap action springs have been disclosed as one way to allow the system to operate in all axes, a magnetic return system utilizing a magnet/coil EMF generator can also be utilized. Referring to FIGS. 14*a* and 14*b*, the bolt 15' includes a pair of magnets 157 and 157'. In FIG. 14*a*, the bolt is in the extended or closed position with the EMF generator designated by the reference numeral 181.

When the bolt 15' is retracted or in the open position, the EMF generator 181 can sense the bolt movement and produce a voltage for driving the memory and sequence elements as shown in FIG. 2.

Figure 15A:
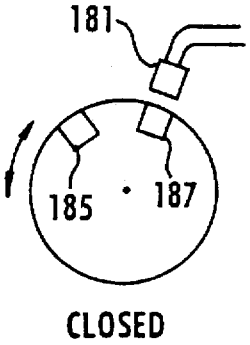
FIGS. 15*a* and 15*b* shown an alternative magnetic non-contact mechanism of the invention.
Figure 15B:
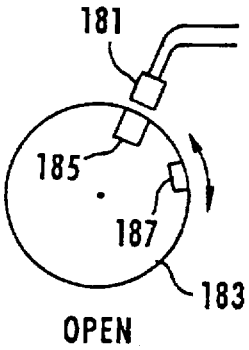

FIGS. 15*a* and 15*b* depict detection of movement using a non-magnetic wheel 183. In this embodiment, the non-magnetic wheel 183 includes a pair of spaced apart magnets 185 and 187. Movement of the wheel between the closed position, FIG. 15*a* and the open position, 15*b*, causes the EMF generator to produce the necessary voltage to operate the system.

Figure 16:
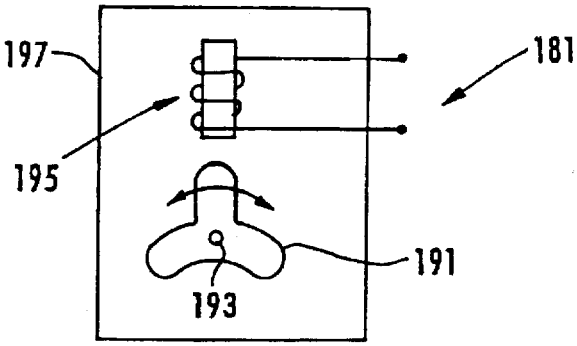
FIG. 16 shows a schematic of an exemplary electromotive force generator.

FIG. 16 shows an exemplary coil/EMF generator 181. The EMF generator 181 includes a magnet 191 which is capable of rotation on its axis 193. A coil pick up 195 is provided to sense the magnetic movement and generate the desired voltage. The coil pick up and magnet can be encased in plastic or glass for use in the combination lock.

It should be understood that the EMF generator 181 is conventional and any known type other than that depicted in FIG. 16 can be utilized with the invention.

Figure 17A:
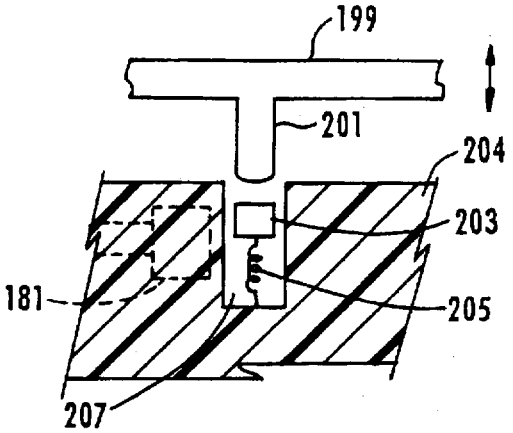
FIGS. 17*a* and 17*b* show a schematic of a portion of the tamper indication system for lock cover removal detection.
Figure 17B:
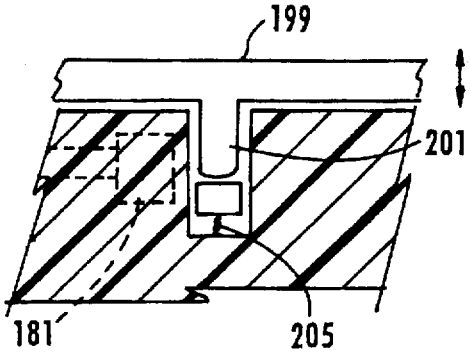

Although bolt movement has been exemplified above, the inventive tamper indication system can also be utilized to detect lock cover removal, dial removal, spindle removal or the like. FIG. 17*a* and 17*b* show a schematic for sensing and indicating lock cover removal. The lock cover 199 is provided with a protrusion 201. Opposite the protrusion 201 is a magnet 203 secured by a biasing spring 205 in the recess 207 formed in the lock casing. Typically, the recess can be formed in the resin material 204 encasing the electrical circuitry of a computerized combination lock.

An EMF generator 181 is disposed along side the recess 207 for detection of movement of the magnet 203.

Referring to FIG. 17*b*, when the lock cover 199 is in place, the spring 205 is compressed by the protrusion 201. Removal of the lock cover 199, see FIG. 17*a*, permits the bias of the spring 205 to force the magnet 203 upwardly within the recess 207, this movement detected by the EMF generator. The generated voltage can then be used to drive the memory and sequence elements as shown in FIG. 2.

Figure 18:
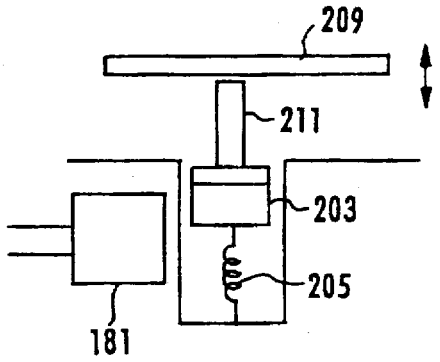
FIG. 18 is a schematic of a portion of the tamper indication system for detecting dial ring removal.

FIG. 18 shows an alternative embodiment wherein a pin 211 is affixed to the magnet 203. In this embodiment, removal of a dial ring 209 can be detected.

Figure 19:
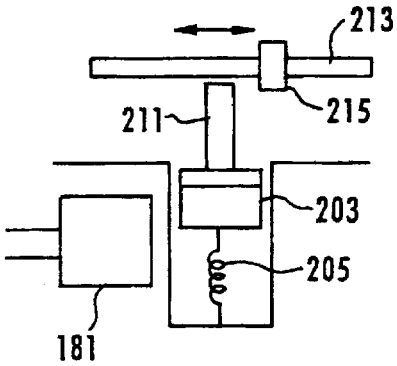
FIG. 19 is a schematic of a portion of the tamper indication system detecting a spindle removal.

FIG. 19 illustrates a schematic for use in detection of a removal of a spindle 213 of a combination lock. The spindle includes a collar 215 which, when in the proper position, compresses the spring 205 similarly to that shown in FIG. 17*b*. Longitudinal translation of the spindle 203 displaces the collar 215 from the pin 211 such that the spring 205 can expand with the magnet 203 moving past the EMF generator 181 for voltage generation.

The embodiments depicted in FIGS. 17–19 are merely exemplary of detection of unauthorized movement of a lock component. The combination dial, dial ring or other critical lock components can be monitored for unauthorized movement, either in a computerized combination lock or a mechanical lock.

When monitoring the movement of the lock components outside of a secured area such as the dial ring, the electronics could be positioned within the dial ring or, alternatively, additional wires through the secured area opening can be utilized for connection to the lock electronics. For example, standard CMOS DIP's or surface mounted electronics can be utilized outside the secured area. These electronics would then be connected to the microprocessor in the lock casing which would then, in return, access the dial and/or spindle EMF/electronics to read or reset the element.

Figure 20:
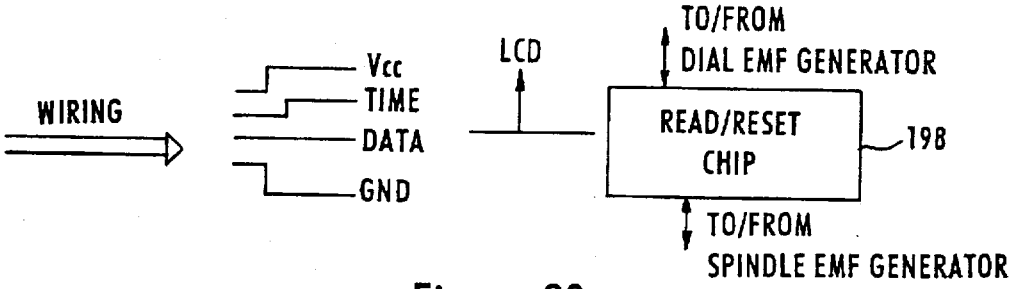
FIG. 20 shows a schematic of the electronic circuitry for tamper detection placed outside a secured area.

FIG. 20 shows a schematic of the additional electronics that could be utilized when an EMF generator is used to detect movement of the dial or spindle. Wiring from the detection devices extends through the secured area door in terms of voltage, data and time. This information is fed to a read/reset chip 198, e.g. a CMOS-type chip. The chip 198 can read the information received from the electronics located in the dial and display it on the LCD if necessary. The chip 198 also functions to reset the electronics in the dial after setting has occurred for subsequent detection.

Figure 21:
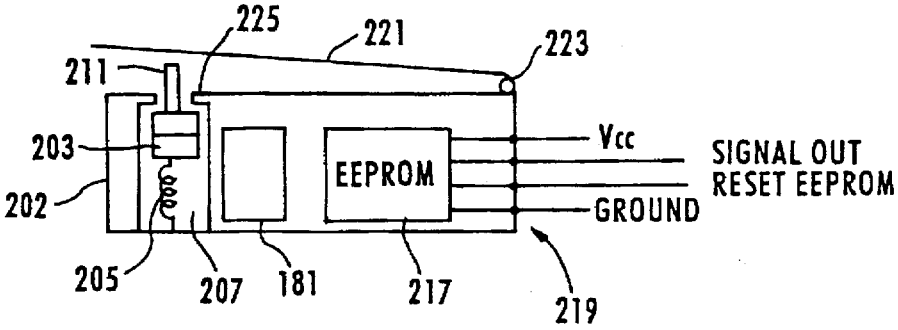
FIG. 21 is a schematic of a self-contained motion detection switch.

Lock component detection can utilize a self-contained switch such as that shown in FIG. 21. The switch includes a body 202 which contains a spring biased assembly comprising the pin 211, magnet 203 and spring 205 as shown in FIG. 18. Also mounted within the body is an EMF generator 181 which sends a signal to the EEPROM 217 provided with contacts 219.

The body 202 includes an actuating arm 221 hinged at 223 to the body 202.

In use, the mechanical motion generated by a component causes depression of the actuating arm 221, which in turn depresses the pin 211. Depression of pin 211 causes magnet 203 to move, thus, causing EMF generator 181 to generate a voltage based upon magnet movement. The EEPROM 217 uses this voltage to power and set a memory element within. This fact can then be accessed via pins 219. The EEPROM can then be reset for sensing of a subsequent actuating arm movement. Of course, an EEPROM with other known means for accessing the information inside can be used in substitution for the EEPROM 217 and contacts 219.

Alternatively, the pin 211 can detect component movement without the need for the actuating arm 221. The pin would be retained in the recess 207 by stops 225 or the spring 205.

Although the embodiments discussed above have generally been directed to resettable devices, a destructible or non-settable device can also be utilized to sense and indicate unauthorized movement of a lock component. For example, a lock cover can be used to form a contact which can be sensed by the microprocessor. Removal of the lock cover would open the contact which can then be committed to memory for detection once the lock is powered up.

Figure 22:
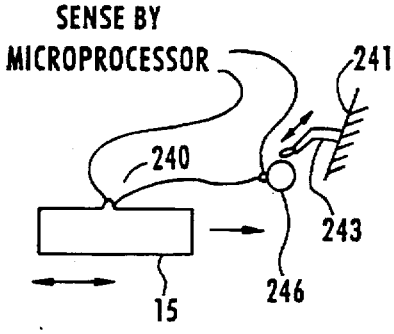
FIG. 22 is a schematic of a destructible mechanism as part of the tamper indication system.

Alternatively, a simple breakable component such as a wire can be mounted to a stationary, or conditionally stationary part of the lock on one end and a movable component part on the other end. Movement of a component part would then break the wire, such a break providing a visual or sensed indication that the component has been moved. The wire could be mounted in connection with any lock component that is moveable. Referring to FIG. 22, a more particle implementation of this concept is illustrated. A wire is attached to bolt 15. The wire 240 is conditionally attached to the lock casing 241 via an interference pin 243, the pin 243 configured to engage or disengage a loop 246 when the lock is properly operated the pin 243 would become disengaged from the loop so the bolt 15 and wire 240 could move. This pin could be independently controlled by a MicroP, or be part of the lock opening components connected in such a way that the pin would engage the wire in the locked position. Retraction of the bolt 15 would break the wire if pulled upon surreptitious entry since the pin 243 would remain engaged in the loop 246. The microprocessor then sensing the discontinuity upon power up would indicate unauthorized bolt retraction. Under normal conditions, the pin would lift out of the looop 246 and the bolt could be pulled without breaking the wire.

The present invention facilitates the detection of unauthorized tampering of a combination lock or surreptitious entry into a secured area. The present invention provides a tamper indication system including means for indicating that one or more components of a combination lock assembly has been improperly manipulated or moved.

The inventive tamper indication system can be used with any combination lock assembly but is especially adapted for computerized combination lock assemblies as disclosed in the Miller et al. patent referenced above. In one embodiment, the tamper indication system can detect retraction of a deadbolt of the combination lock assembly and indicate that such retraction has occurred to alert an authorized user of the combination lock that some degree or level of tampering has occurred.

The tamper indication system can also be utilized to detect removal of a combination dial or other rotatable member or any other component outside of an area secured by the combination lock. Alternatively, the inventive tamper indication system can be utilized to monitor manipulation of components within the secured area such as a lock casing cover.

In its broadest embodiment, the invention uses a means for sensing unauthorized movement of a component of the combination lock and for indicating that such authorized movement has occurred so that the appropriate action can be taken. The tamper indication system of the invention can be designed using an external power source such as a battery or AC current or can operate without benefit of the external power source.

When using the inventive system without an external power source, the system can utilize either an active source or passive source for indicating the unauthorized component movement. An active source is considered a system which employs a mechanical motion that is related to the unauthorized component manipulation, this mechanical motion being transformed into an electromotive force which provides electrical energy for indication purposes.

Alternatively, the passive source is a mechanism that can operate without electrical energy for indicating purposes.

The tamper indication system can also use either contact or non-contact devices to sense the unauthorized component removal. Examples of contact systems would include spring loaded pins or the like which are in contact with a component and react when the component is moved. Non-contact systems can employ magnets or the like to monitor the component manipulation.

In another embodiment of the invention, a self contained detection switch is provided which can sense movement of a component and provide an indication that the component has been moved for tamper indication purposes.

Unless a destructive means is used for sensing and indicating the unauthorized component movement, e.g. a wire that can be broken upon the movement, a reset feature is provided which allows the tampered indication system to be reset once the unauthorized component movement has been detected and the appropriate action taken. The reset feature can be either mechanical, electronic or magnetic as described below. Resetting can be achieved, for example, by one or more correct dialings of the combination.

The invention can be used with any known type of a combination lock including known types where combinations are inputted by a push button mechanism or types where some rotative movement is used for combination inputting.

As such, an invention has been disclosed in terms of preferred embodiments thereof which each and every one of the advantages sought with the present invention as set forth hereinabove and which provides a tamper indication system for combination locks.

Of course, various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. A computerized combination lock for a secured area comprising:

a) a combination inputting device mounted outside of said secured area;

b) a power source;

c) a microprocessor and lock assembly arranged within said secured area and being powered by said power source for operation of said computerized combination lock by entering a combination;

d) a display linked to movement of said combination inputting device for combination dialing; and e) means for non-contact sensing of unauthorized movement of a component of said computerized combination lock and indicating occurrence of said unauthorized movement, wherein said non contact sensing means includes at least one pair of magnets.

2. In a combination lock for a secured area comprising a combination inputting device mounted outside of said secured area and a lock assembly arranged within said secured area for operation of said combination lock by entering of a combination by said combination inputting device, the improvement comprising means for detecting unauthorized movement of a component of said combination lock and indicating occurrence of said unauthorized movement, wherein said means for sensing and indicating is a breakable component.

3. A self contained motion detection switch comprising a switch housing, said switch housing including an electromotive force generator, a spring biased pin and magnet assembly wherein said pin is mounted in said switch housing to detect motion, to drive said magnet and permit detection of the magnet driving by said electromotive force generator, a means for sensing output of said electromotive force generator and providing a signal indicative of said motion and an actuating arm pivotally mounted to said switch housing for detection of said motion, said pin contacting said actuating arm for driving said magnet during motion detection by said actuating arm.

4. The self contained motion detection switch of claim 3 wherein said means for sensing and providing comprises an electrically erasable programmable read only memory.

* * * * *